United States Patent [19]

Stahlecker

[11] Patent Number: 5,067,315

[45] Date of Patent: Nov. 26, 1991

[54] PROCESS FOR SPLICING THE ENDS OF TWO DOUBLE YARNS

[75] Inventor: Fritz Stahlecker, Bad Ueberkingen, Fed. Rep. of Germany

[73] Assignee: Hans Stahlecker, Fed. Rep. of Germany; a part interest

[21] Appl. No.: 614,677

[22] Filed: Nov. 19, 1990

Related U.S. Application Data

[63] Continuation of Ser. No. 365,841, Jun. 15, 1989, abandoned.

[30] Foreign Application Priority Data

Jun. 25, 1988 [DE] Fed. Rep. of Germany ..... 3821570

[51] Int. Cl.[5] ..... D01H 1/115; D01H 15/00

[52] U.S. Cl. ..... 57/22; 57/328; 57/333

[58] Field of Search ..... 57/22, 261, 328, 333, 57/350

[56] References Cited

U.S. PATENT DOCUMENTS

| | | | |
|---|---|---|---|
| 3,903,680 | 9/1975 | Isern | 57/22 |
| 3,985,089 | 10/1976 | Yacono | 57/209 X |
| 4,445,318 | 5/1984 | Becker et al. | 57/22 |
| 4,537,019 | 8/1985 | Matsui et al. | 57/22 X |
| 4,720,966 | 1/1988 | Speranzin et al. | 57/261 X |
| 4,790,130 | 12/1988 | Stahlecker et al. | 57/328 X |

FOREIGN PATENT DOCUMENTS

| | | | |
|---|---|---|---|
| 3634464 | 4/1988 | Fed. Rep. of Germany | 57/328 |

*Primary Examiner*—Joseph J. Hail, III

*Attorney, Agent, or Firm*—Evenson, Wands, Edwards, Lenahan & McKeown

[57] ABSTRACT

In the case of a process for the splicing of the ends of two double yarns during a piecing operation at a spinning unit, it is provided that either the ends to be spliced are prepared such that the spliced point is a thin point, or that the spliced double yarn is pneumatically strengthened in the area of the spliced point.

9 Claims, 2 Drawing Sheets

PROCESS FOR SPLICING THE ENDS OF TWO DOUBLE YARNS

This is a continuation of application Ser. No. 07/365,841, filed June 15, 1989, now abandoned.

BACKGROUND AND SUMMARY OF THE INVENTION

The invention relates to a process for splicing the ends of two double yarn components during a piecing operation at a spinning unit of the type, which spins two yarn components, which components are guided together to form the double yarn and, as the double yarn, are wound onto a spool package which serves as a feeding package for twisting.

An object of the invention is to develop, in this type of a process, the spliced connection in such a manner that it is not noticeable in the future twisted yarn; i.e., that, it impairs the appearance and the strength as little as possible in the future twisted yarn.

According to a first preferred embodiment of the invention, it is provided that the ends to be spliced are prepared such that the spliced point is a thin point.

In this embodiment, an increased strength is not achieved in the area of the spliced point before the twisting, specifically since, during the twisting, an increased amount of twist enters into this thin point and increases the strength there.

In another embodiment, it is provided that the spliced double yarn is subsequently fastened pneumatically in the area of the spliced point. In this case, the double yarn obtains an increased strength in the area of the spliced point even before the twisting.

In a further development of preferred embodiments of the invention, it is provided that, during the splicing of the ends of the double yarn, a spliced connection is produced with at least one moderately long, tail-like yarn end, after which the yarn end is wound around the double yarn. This winding-around may take place particularly intensively by means of an additional pneumatic device, particularly by means of a pneumatic false-twisting nozzle.

Other objects, advantages and novel features of the present invention will become apparent from the following detailed description of the invention when considered in conjunction with the accompanying drawings.

DETAILED DESCRIPTION OF THE DRAWINGS

Figure 1:
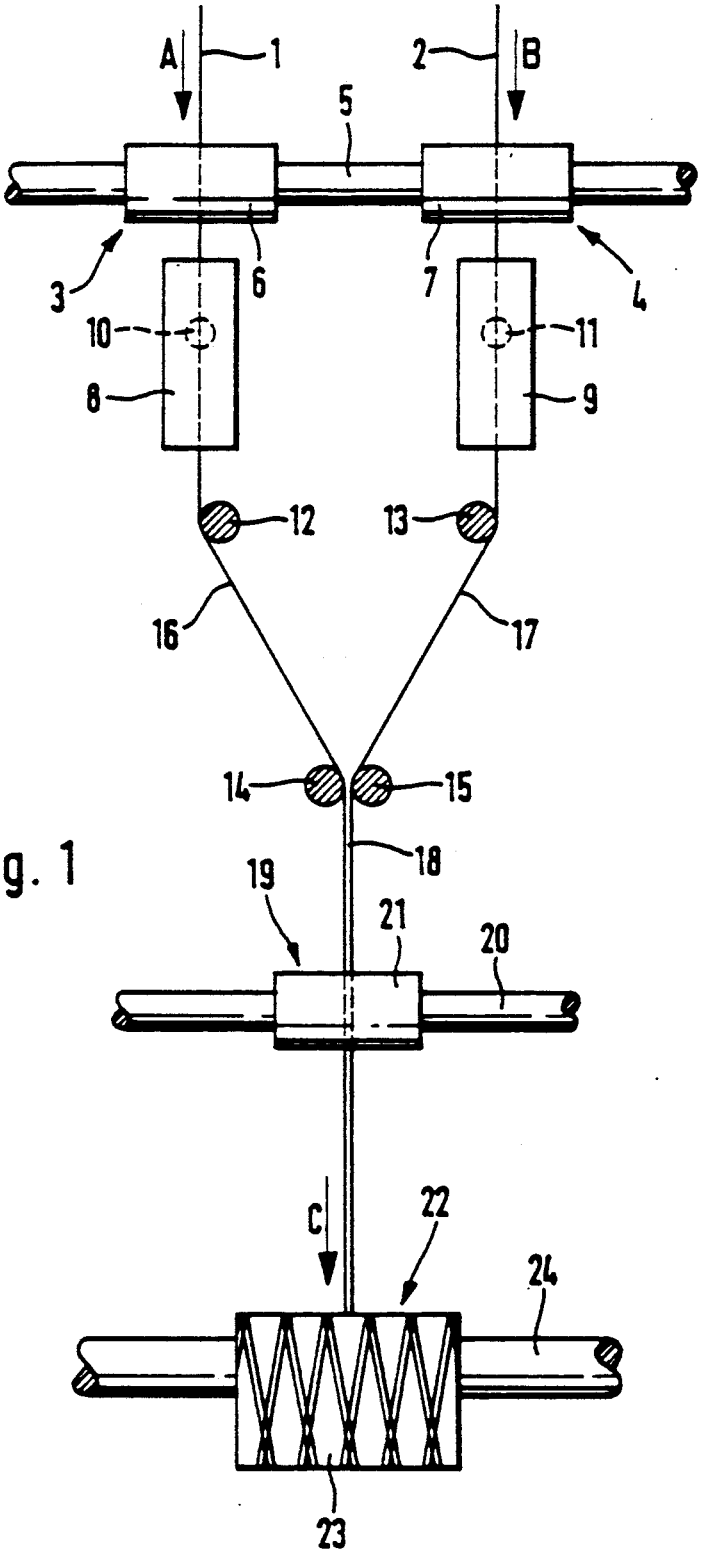
FIG. 1 is a schematic view of an individual spinning unit for the spinning and winding of a double yarn onto a spool for use in conjunction with preferred embodiments of the present invention.

The spinning unit shown in FIG. 1 contains two drafting units 3, 4, in which slivers 1, 2 are drafted or drawn to the desired yarn size, and traverse in the direction of the arrows (A, B). Of the drafting units 3, 4, only the delivery roller pairs are shown, which are formed by a driven bottom cylinder 5, which extends through in the longitudinal direction of the machine, as well as by pressure rollers 6, 7.

The drafting units 3, 4 are followed by pneumatic false-twisting devices, in which the drawn slivers are prestrengthened to form yarn components 16, 17. The pneumatic false-twisting devices each contain at least one false-twisting nozzle 8, 9, which are connected to compressed-air lines 10, 11. These false-twisting nozzles 8, 9 provide the slivers 1, 2 with a false twist, which opens up again when the slivers 1, 2 leave the false-twisting nozzles 8, 9. In this case, only yarn ends remain wound around the yarn core, which consists essentially of parallel fibers. The strength of the two yarns 16, 17 is relatively weak, so that they cannot yet be processed as a finished yarn. They do not receive sufficient strength before they are later twisted together with one another.

The two yarns 16, 17 are guided together to form a double yarn 18 by means of yarn guides 12, 13, 14, 15. Double yarn 18 is withdrawn by means of a withdrawal device 19. The withdrawal device 19 contains a driven cylinder 20, which extends through in the longitudinal direction of the machine, and a pressure roller 21. The double yarn 18 will then travel in the direction of the arrow (C) to a wind-up device 22, by means of which the double yarn 18 will then be wound onto a cross-wound package 23. The wind-up device 22 which is shown only very schematically, contains a winding roller 24, which is constructed as a driven cylinder extending through in the longitudinal direction of the machine and which drives the package 23. The package 23 with the wound-up double yarn 18 is used as a feeding package for a subsequent twisting operation, during which the double yarn 18 obtains its final strength.

When one or both yarns 16, 17 break, the supply of sliver to the drafting units 3, 4 is interrupted. A servicing carriage will then be called, which is applied to the respective spinning unit and which will then carry out a piecing operation. For this purpose, the servicing carriage winds a double yarn off the package 23, which is lifted off the winding roller 24, this double yarn will then be reconnected with a newly spun double yarn 18. For this purpose, the spinning operation is resumed, and a double yarn is again furnished by the withdrawal device 19. The double yarn 18 coming from the withdrawal device 19 as well as the double yarn withdrawn from the package 23 are entered into a splicing arrangement 28 and are connected with one another in this splicing arrangement 28. Then the winding of the double yarn onto the package 23 will be resumed, which is at first controlled by the servicing carriage, which, after the excess yarn length created during the splicing was used up, returns the package to the spinning unit.

In order to achieve that the produced spliced connection will not be particularly noticeable with respect to its appearance and strength in the later produced twisted yarn, it is provided in a first embodiment that, during the splicing operation, the spliced point is intentionally produced as a thin point. During the subsequent twisting, somewhat more twist will enter into this thin point so that an increased strength will be created in this area. It is, however, provided in this case that this increased twist and also the shape of the thin point are still within the scope of the conventional tolerances of the twisted yarn.

In order to produce a thin point in the area of the spliced point, the ends of the double yarn 18, which are to be connected, are prepared such in the area of the future spliced point that the fiber quantity is reduced. In this case, the fiber quantity, in each of the two double yarns to be connected, is reduced to less than 50% of the normal fiber quantity. This may be carried out in that the area of the later spliced point is separated into fibers and thinned, for example, by means of a suction air flow or a compressed-air flow. In another solution, it is provided that this area is drawn before the splicing. This is possible because the two yarns 16, 17 have only a relatively low strength and may be drawn one more time without being destroyed.

In another solution, it is provided that following the splicing arrangement 28, which is a component of the servicing device, a device for a pneumatic strengthening is arranged in the path of the yarn, particularly a false-twisting nozzle 31. The splicing arrangement 28 has a splicing groove 29, into which the double yarns 16, 17 as well as the double yarn 18 coming from the package are deposited. The splicing takes place pneumatically, in that compressed air is blown in through a blow opening 30. After the spliced connection is established, the double yarn 18 is withdrawn again in the direction of the arrow (C), also passing through the duct 32 of the false-twisting nozzle 31, which, during this time period, through a compressed-air line 33, is acted upon by compressed air. By means of this additional pneumatic strengthening, which expediently is limited as directly as possible to the 10 area of the spliced point, an increased strength is achieved in the spliced point.

Figure 2:
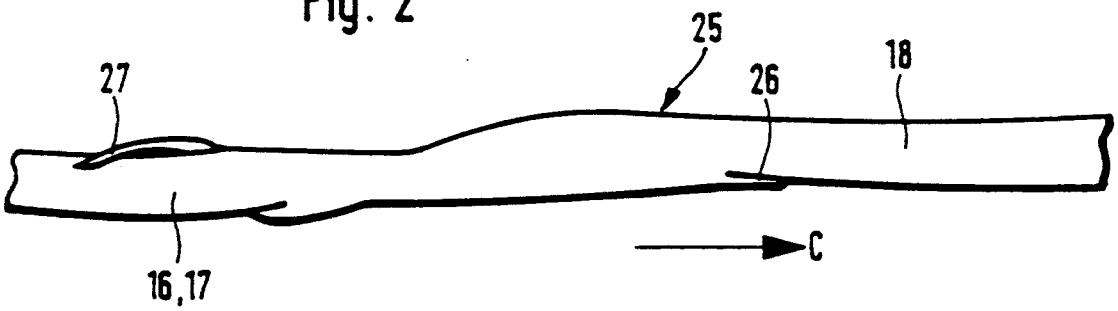
FIG. 2 is a very enlarged schematic view of a spliced connection of the type contemplated by the present invention.
Figure 3:
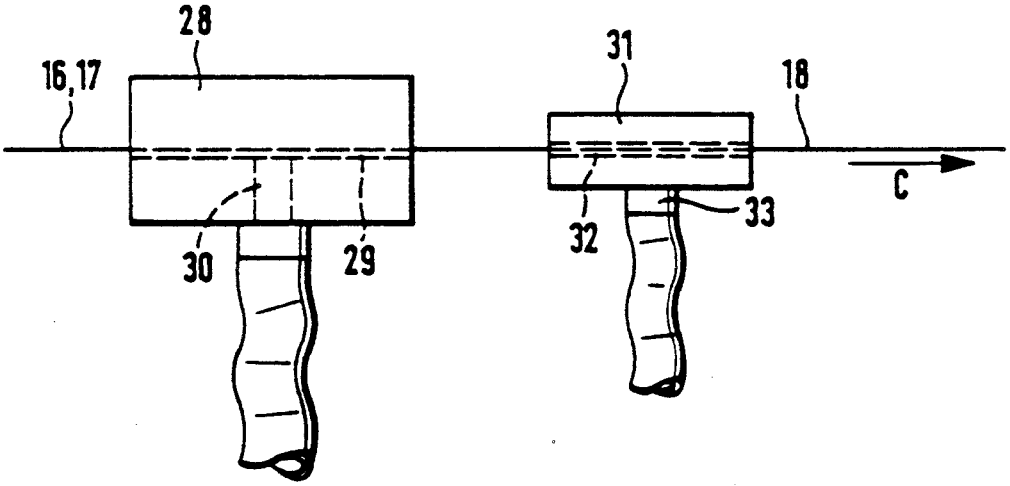
FIG. 3 is a schematic representation of a splicing arrangement, which is followed by a device for the pneumatic strengthening of the spliced point, constructed in accordance with a preferred embodiment of the present invention.

FIG. 2 shows the area of a spliced point 25 between the double yarns 16, 17 coming from the delivery device 19 and the double yarn 18 coming from the package. In this case, the twist and the courses of the fibers are not shown, because, in the area of the spliced point 25, a swirling-together and mixing of the fibers is obtained anyhow. As shown in FIG. 2, the splicing was carried out such that the end 27 of the double yarn 18 coming from the package projects beyond the actual spliced point 25 by a relatively long length, i.e. by a length of up to 2 cm. This yarn end 27, which was thinned out by means of raveling out, is spirally wound around the double yarn 16, 17. This may be achieved in a false-twisting nozzle 31 or by means of a deliberate designing of the splicing arrangement 28. In contrast, the end 26 of the double yarn 16, 17 projects beyond the actual spliced point 25 by an only relatively short length.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A process for splicing the ends of two double yarns during a piecing operation at a spinning unit of the type which spins two yarns which are guided together to form the double yarn and, as the double yarn, are wound onto a spool which serves as a feeding package for subsequent twisting, said process comprising:

preparing the yarn ends to be spliced by reducing their fiber quantity level below the fiber quantity level of normally spun yarn, and splicing the yarn ends to form a spliced section which has less fibers per cross-section than overlapping sections of normally spun yarn, thereby forming an intentionally weaker thin spliced section to be subsequently twisted, wherein said reducing of their fiber quantity includes reducing their fiber quantity to less than half their normally spun fiber quantity, thereby assuring that the spliced section has less fiber per cross-section than normally spun yarn.

2. A process according to claim 1, further comprising subjecting the spliced yarn to a twisting operation with consequent increased strengthening of the thin spliced section as compared to adjacent normally spun yarn subjected to the same twisting operation.

3. A process for splicing the end of two double yarns during a piecing operation at a spinning unit of the type which spins two yarns which are guided together to form the bundle yarn and, as the double yarn, are wound onto a spool package which serves as a feeding package for subsequent twisting, said process comprising:

splicing the yarn ends to form a spliced section, and subsequently strengthening the double yarn by pneumatic false twisting substantially only in the area of the spliced section while the double yarn is moving after the splicing is completed to thereby increase strength of the spliced section.

4. A process according to claim 3, wherein said pneumatically strengthening includes guiding the double yarn through a pneumatic false twisting nozzle before being wound onto a spool package.

5. A process according to claim 4, wherein during the splicing of the ends of the double yarn, a spliced connection is produced with at least one moderately long tail-like yarn end, this yarn end subsequently being wound around the double yarn.

6. A process according to claim 3, wherein during the splicing of the ends of the double yarn, a spliced connection is produced with at least one moderately long tail-like yarn end, this yarn end subsequently being wound around the double yarn.

7. Apparatus for splicing the ends of two double yarns during a piecing operation at a spinning unit of the type which spins two yarns which are guided together to form the double yarn and, as the double yarn, are wound onto a spool package which serves as a feeding package for subsequent twisting, said apparatus comprising:

splicing means for splicing the yarn ends to form a spliced section, and spliced section strengthening means for subsequently strengthening the double yarn by pneumatic false twisting substantially only in the area of the spliced section while the double yarn is moving after the splicing is completed to thereby increase strength of the spliced section.

8. Apparatus according to claim 7, wherein said spliced section strengthening means includes means for guiding the double yarn through a pneumatic false-twisting nozzle before being wound onto a spool package.

9. Apparatus according to claim 7, wherein the spliced section strengthening means includes means for producing a spliced connection with at least one moderately long tail-like yarn end, this yarn end subsequently being wound around the double yarn.

* * * * *